US008177461B2

(12) United States Patent
Schutz et al.

(10) Patent No.: US 8,177,461 B2
(45) Date of Patent: May 15, 2012

(54) TRANSPORT AND STORAGE OF WHEELSETS

(75) Inventors: Elijah Allen Schutz, Portland, OR (US); Troy Gene Lavoie, Troutdale, OR (US); Eric Paul Mergen, Portland, OR (US)

(73) Assignee: Gunderson LLC, Portland, OR (US)

( * ) Notice: Subject to any disclaimer, the term of this patent is extended or adjusted under 35 U.S.C. 154(b) by 210 days.

(21) Appl. No.: 12/798,707

(22) Filed: Apr. 9, 2010

(65) Prior Publication Data

US 2011/0250032 A1 Oct. 13, 2011

(51) Int. Cl.
*B60P 7/12* (2006.01)

(52) U.S. Cl. ..... 410/33

(58) Field of Classification Search ..... 410/33, 410/35, 36, 42, 44, 46, 47, 9, 19, 30
See application file for complete search history.

(56) References Cited

U.S. PATENT DOCUMENTS

| | | | | |
|---|---|---|---|---|
| 717,488 | A | 5/1903 | Swanson | |
| 1,085,196 | A | 1/1914 | Downing | |
| 1,110,394 | A | 9/1914 | Lindall | |
| 1,114,552 | A | 10/1914 | Taurman | |
| 1,168,335 | A | 1/1916 | Rowntree | |
| 1,420,386 | A | 6/1922 | Roth | |
| 1,617,658 | A | 2/1927 | Suarez | |
| 1,626,709 | A | 5/1927 | Walthall | |
| 1,634,490 | A | 7/1927 | Collis | |
| 1,643,544 | A | 9/1927 | Cushnyr | |
| 1,696,332 | A | 12/1928 | Sheehan | |
| 1,699,520 | A | 1/1929 | Gibbs et al. | |
| 1,699,529 | A | 1/1929 | Gibbs et al. | |
| 1,875,584 | A | 9/1932 | Frede et al. | |
| 1,889,605 | A | 11/1932 | Jones | |
| 2,052,213 | A | 8/1936 | Branstrator | |
| 2,194,356 | A | 3/1940 | Eklund | |
| 2,255,900 | A | 9/1941 | Schlessinger | |
| 2,278,554 | A | 4/1942 | Morton | |
| 2,279,756 | A | 4/1942 | Lieberman | |
| 2,283,308 | A | 5/1942 | Bean | |
| 2,283,309 | A | 5/1942 | Bean et al. | |
| 2,327,585 | A | 8/1943 | Ulrich | |
| 2,401,401 | A | 6/1946 | Bartsch | |
| 2,504,112 | A | 4/1950 | Dean et al. | |
| 2,788,179 | A * | 4/1957 | Hafer et al. | 238/1 |
| 2,810,602 | A | 10/1957 | Abrams | |

(Continued)

FOREIGN PATENT DOCUMENTS

| | | |
|---|---|---|
| DE | 3711409 | 10/1987 |

(Continued)

OTHER PUBLICATIONS

U.S. Appl. No. 11/985,400, filed Nov. 4, 2007, Saxton et al.

*Primary Examiner* — H Gutman
(74) *Attorney, Agent, or Firm* — Chernoff Vilhauer McClung & Stenzel LLP

(57) ABSTRACT

A rack defining receptacles for holding railroad car wheelsets arranged in an echelon pattern with the axles of the wheelsets oriented obliquely with respect to the width of the rack. The rack is of strong yet light construction. The rack has a length and width about equal to those of a 20-foot ISO intermodal cargo container and is equipped with corner fittings compatible with conventional container-handling and container-carrying equipment.

15 Claims, 8 Drawing Sheets

U.S. PATENT DOCUMENTS 3,102,613 A 9/1963 Johnston
3,111,234 A 11/1963 Bower et al.
3,152,667 A 10/1964 Johnston
3,152,669 A 10/1964 Johnston
3,181,440 A 5/1965 Mullaney et al.
3,290,058 A 12/1966 Ellerd
3,308,769 A 3/1967 Halcomb et al.
3,319,583 A 5/1967 Gutridge
3,357,371 A 12/1967 Gutridge
3,389,663 A 6/1968 Gutridge
3,420,192 A 1/1969 Ellis
3,520,256 A 7/1970 Gutridge
3,616,764 A 11/1971 Johnson et al.
3,645,213 A 2/1972 Taylor
3,659,724 A 5/1972 Miller et al.
3,731,967 A 5/1973 Hughes
3,818,843 A 6/1974 Lee
3,981,548 A 9/1976 MacDonnell et al.
4,064,947 A 12/1977 Cole
4,091,742 A 5/1978 Cordani
4,150,628 A 4/1979 Keldenich
4,179,997 A 12/1979 Kirwan
4,191,107 A 3/1980 Ferris et al.
4,220,437 A 9/1980 DeWitt
4,233,909 A 11/1980 Adams et al.
4,274,776 A 6/1981 Paton et al.
4,288,957 A 9/1981 Meehan
4,331,083 A 5/1982 Landregan et al.
4,408,810 A 10/1983 Geyer
4,428,296 A 1/1984 Scheuchzer et al.
4,452,147 A 6/1984 Jwuc
4,456,413 A 6/1984 Pavlick
4,488,649 A 12/1984 Mark
4,524,699 A 6/1985 Pavlick
4,551,049 A 11/1985 Klosk
4,563,957 A 1/1986 Billingsley et al.
4,597,337 A 7/1986 Willetts
4,599,949 A 7/1986 Hill
4,624,188 A 11/1986 Kaleta
4,671,714 A 6/1987 Bennett
4,686,907 A 8/1987 Woollam et al.
4,703,699 A 11/1987 Hill
4,718,353 A 1/1988 Schuller et al.
4,741,273 A 5/1988 Sherwood
4,750,431 A 6/1988 Yates et al.
4,751,882 A 6/1988 Wheatley et al.
4,754,709 A 7/1988 Gramse et al.
4,771,706 A 9/1988 Lindauer et al.
4,782,762 A 11/1988 Johnstone et al.
4,792,269 A 12/1988 Engle
4,798,148 A 1/1989 Girard
4,802,420 A 2/1989 Butcher et al.
4,805,539 A 2/1989 Ferris et al.
4,807,722 A 2/1989 Jamrozy et al.
4,841,876 A 6/1989 Gramse et al.
4,862,810 A 9/1989 Jamrozy et al.
4,864,938 A 9/1989 Hesch et al.
4,876,968 A 10/1989 Lindauer et al.
4,889,055 A 12/1989 Jamrozy et al.
4,893,567 A 1/1990 Hill et al.
4,901,649 A 2/1990 Fehrenbach et al.
4,905,608 A 3/1990 Terlecky et al.
4,909,157 A 3/1990 Jamrozy et al.
4,911,082 A 3/1990 Richmond
4,929,132 A 5/1990 Yeates et al.
4,947,760 A 8/1990 Dawson et al.
4,949,646 A 8/1990 Jamrozy et al.
4,951,575 A 8/1990 Dominguez et al.
4,955,144 A 9/1990 Lienard et al.
4,966,082 A 10/1990 Takeichi et al.
5,001,990 A 3/1991 Pavlick
5,017,064 A 5/1991 Kirwan et al.
5,020,445 A 6/1991 Adams, Jr.
5,054,403 A 10/1991 Hill et al.
5,085,152 A 2/1992 Tylisz et al.
5,090,331 A 2/1992 Hesch et al.
5,170,718 A 12/1992 Hill et al.
5,197,392 A 3/1993 Jeunehomme
5,207,161 A 5/1993 Pileggi et al.
5,216,956 A 6/1993 Adams, Jr.
5,246,321 A 9/1993 Hesch
5,279,230 A 1/1994 Thomas et al.
5,372,073 A 12/1994 Cattani
5,407,309 A 4/1995 Hesch et al.
5,423,269 A 6/1995 Saxton et al.
5,452,664 A 9/1995 Richmond
5,465,670 A 11/1995 Butcher
5,501,556 A 3/1996 Butcher
5,509,534 A 4/1996 Taravella et al.
5,511,491 A 4/1996 Hesch et al.
5,520,489 A 5/1996 Butcher et al.
5,611,285 A 3/1997 Saxton
5,626,083 A 5/1997 Saxton
5,657,698 A 8/1997 Black, Jr. et al.
5,730,063 A 3/1998 Forbes et al.
5,743,191 A 4/1998 Coslovi
5,749,686 A 5/1998 Butcher et al.
6,003,445 A 12/1999 Coslovi et al.
6,095,055 A 8/2000 Lohr et al.
6,196,137 B1 3/2001 Forbes
6,199,486 B1 3/2001 Landrum et al.
6,357,363 B1 3/2002 Militaru
6,505,564 B2 1/2003 Khattab
6,510,800 B1 1/2003 Zaerr et al.
6,546,878 B1 4/2003 Smith et al.
6,572,313 B2 6/2003 Porto
6,584,912 B2 7/2003 Forbes
6,997,331 B2 * 2/2006 Lobe ..... 211/59.4
7,546,922 B2 6/2009 Howard
2007/0261593 A1 11/2007 Saxton

FOREIGN PATENT DOCUMENTS

EP 0510372 10/1992
EP 0510467 10/1992
RU 2118263 8/1998

* cited by examiner

TRANSPORT AND STORAGE OF WHEELSETS

BACKGROUND OF THE INVENTION

The present invention relates to handling, carriage, and storage of heavy pairs of wheels connected by axles, such as railroad car wheelsets, and relates particularly to apparatus for use in storage and carriage of such pairs of wheels and that is compatible with the handling of intermodal cargo containers.

Railroad car wheels are permanently mounted on axles that extend beyond the wheels. Bearings are mounted on the outer ends of such axles. A pair of wheels, an associated axle, and the associated bearing assemblies are called a wheelset, and such a wheelset is usually handled as a unit. A wheelset for a railroad freight car usually has a weight in the range of roughly 2,400 pounds, for a pair of 33-inch wheels, to roughly 3,500 pounds for a pair of 38-inch wheels. Most railroad freight car wheels are 36-inch wheels, with 33-inch and 38-inch wheels being somewhat less common.

During normal use railroad car wheels may wear unevenly, requiring the wheels to be resurfaced to an acceptable profile and circularity. New wheelsets, wheelsets needing reworking, and wheelsets that have been reworked must be transported to or from car building or repair facilities.

The axial length of a wheelset for use on standard-gauge North American railroad track is up to about 89⅝ inches. This is greater than the interior width of a conventional ISO cargo container, so railcar wheelsets have not previously been carried in cargo containers with the axles oriented parallel with the width of such a container, although handling a container carrying a group of wheelsets in a single operation would be preferred. Instead, wheelsets have usually been loaded individually onto a flatbed highway trailer or a railroad flatcar for transport, with the axles aligned perpendicular to the direction of travel. The wheelsets have usually had to be handled and secured individually to keep them properly in place. Securing wheelsets for carriage in that way requires personnel to be on a flatcar or trailer while it is being loaded, although this procedure risks serious injury to such personnel. In case of a collision involving the truck or flatcar carrying wheelsets in this manner the wheelsets have been likely to break loose and roll about uncontrollably.

To utilize available space economically on a flatcar or trailer wheelsets have been carried in staggered arrangements, with adjacent wheelsets offset from each other axially of the wheelsets, in alternating directions. Such arrangements, however, risk damage to a bearing assembly of a wheelset, which may be struck by a wheel of an adjacent wheelset as it is moved by a crane during loading or unloading of a flatcar or trailer.

In order to keep a trailer or railcar available for transporting other loads, wheelsets have been unloaded from the flatcar or trailer for storage at a facility where the wheels are to be reworked or are to be installed on a railroad car. This has required each wheelset again to be handled individually, resulting in significant associated costs for labor and the use of cranes or other handling equipment, and requiring allocation of space for temporary storage of wheelsets, as well as later handling of wheelsets one-by-one when they are to be reworked or installed.

Specially-equipped railcars for carrying wheelsets have included sets of rails on which wheelsets can be carried, either aligned with each other or in staggered arrangements, as shown in U.S. Pat. No. 1,626,709, but such railcars have not been widely used, and wheelsets have still had to be secured individually on such railcars and are still susceptible to rolling off in case of a collision that causes the railcar to be stopped abruptly.

What is needed, then, is a way to handle, carry, and store railroad car wheelsets more safely and economically than has previously been possible. It is also desirable to be able to carry and store such wheelsets in apparatus that is compatible with handling, storage, and transport of intermodal cargo containers.

SUMMARY OF THE DISCLOSURE

The present invention provides an answer to some of the aforementioned needs, as defined by the claims appended hereto.

As a primary aspect of the present invention a rack or support apparatus is provided that can receive and carry or hold a plurality of railcar wheelsets and that can be handled, stored, and transported in the same manner as an intermodal cargo container.

In one embodiment disclosed herein the previously mentioned support apparatus or rack includes a main longitudinal member with a top member that defines an opening shaped to receive a portion of a wheel of a railcar wheelset, with the axle of such a wheelset oriented horizontally and at an oblique angle to the width of the rack.

In one embodiment of such a wheelset support apparatus or rack as disclosed herein a plurality of pairs of such openings are provided, spaced apart from one another along the length of the rack.

In one embodiment, the rack or support apparatus disclosed herein is equipped with intermodal cargo container corner fittings in locations compatible with standard intermodal cargo container handling equipment, so that the apparatus can be handled by conventional intermodal container-handling cranes and can be carried and secured in conventional intermodal container-carrying trailer chassis, railcar container wells, or container cells of a ship, to be carried thus to a desired destination.

In one embodiment, the apparatus disclosed herein has a height equal to about half that of a standard intermodal cargo container, so that a pair of such apparatus can be stacked and transported in place of a standard cargo container.

In one embodiment of the apparatus disclosed herein, corner posts are supported by diagonal braces and are constructed with sufficient strength to permit stacking of such apparatus when fully loaded with wheelsets, so that the support apparatus can be placed on the ground and stacked to store wheelsets in a small area.

The foregoing and other features of the invention will be more readily understood upon consideration of the following detailed description taken in conjunction with the accompanying drawings.

BRIEF DESCRIPTION OF THE SEVERAL DRAWINGS

DETAILED DESCRIPTION OF PREFERRED EMBODIMENTS

Figure 1:
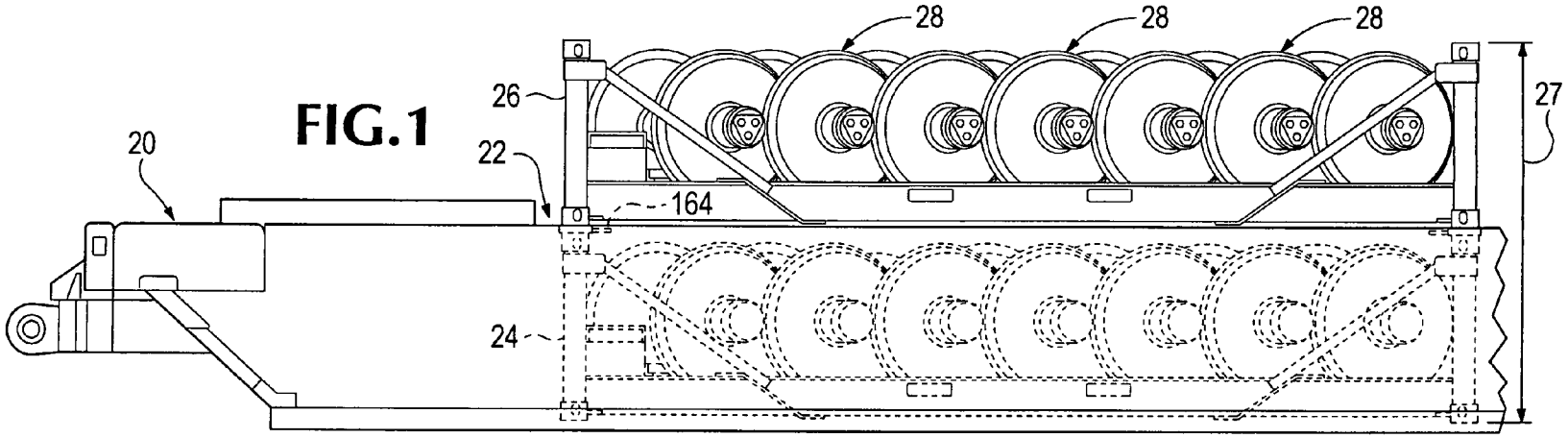
FIG. 1 is a side elevational view of a portion of a railroad freight car body designed for carrying intermodal cargo containers, and showing a pair of wheel racks for carrying railroad freight car wheelsets stacked in the container well of the car body.

Referring now to the drawings which form a part of the disclosure herein, in FIG. 1, a railroad freight car body 20, of which only one half is shown, includes a container well 22 in which are stacked a pair of wheelset-carrying racks 24 and 26. Seven railroad freight car wheelsets 28 are carried in each of the racks 24 and 26. The lower rack 24 is located within the container well 22, resting on the usual container supports (not shown), while an upper rack 26 is stacked atop the lower rack 24 and is interconnected with it in the same fashion in which conventional intermodal containers are stacked upon and interconnected with each other for carriage in a railroad freight car container well, but the two racks 24 and 26 together have a combined height 27 of about 8 feet, the same as the height of an ordinary ISO 20-foot intermodal cargo container.

Figure 2:
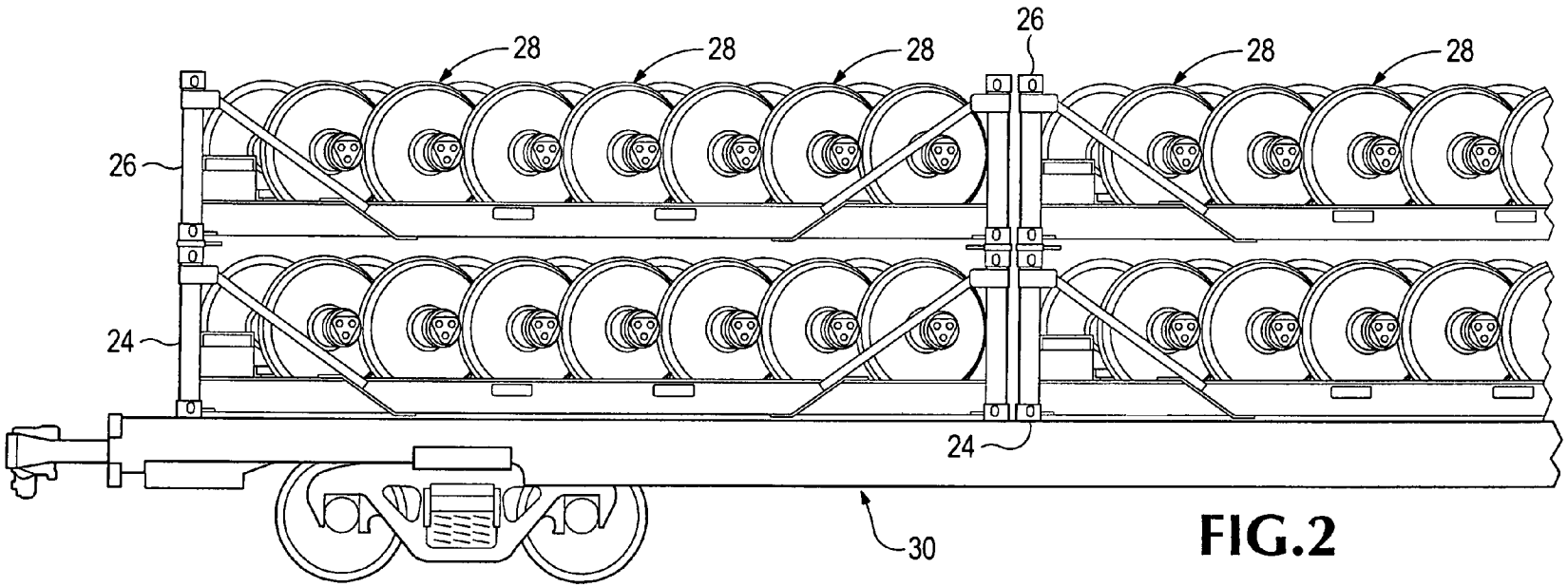
FIG. 2 is a side elevational view of a portion of a railroad flatcar carrying racks loaded with railroad freight car wheelsets.

In FIG. 2, part of a flatcar 30 is shown with four similar wheelset supporting racks 24 and 26 shown carried atop the flatcar 30. Depending upon the length and capacity of the flatcar 30, additional such racks 24 and 26 might also be carried on the same flatcar 30. As in FIG. 1, each of the racks 24 and 26 carries seven wheelsets 28.

Figure 3:
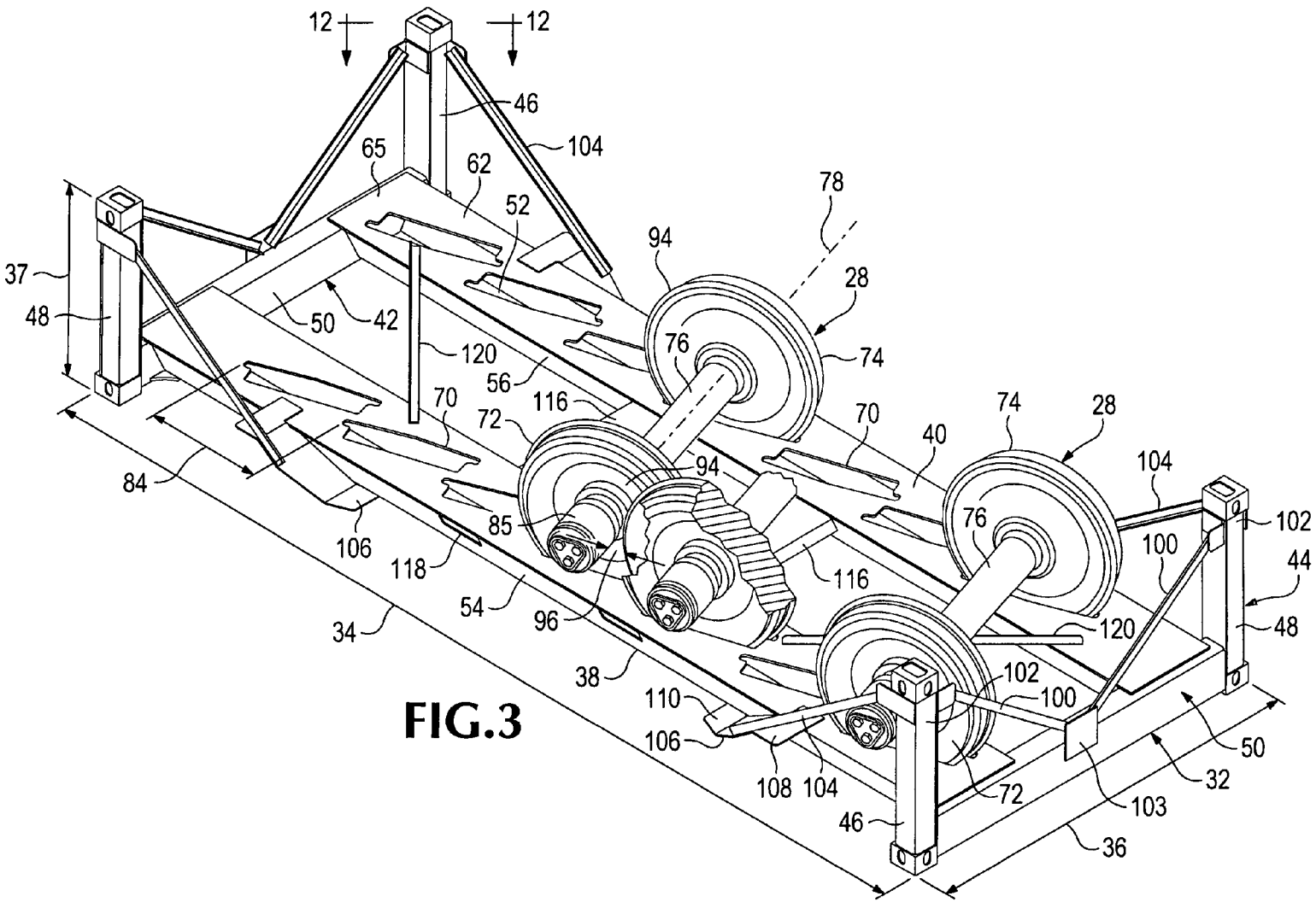
FIG. 3 is an isometric view from above one end of a rack such as those shown in FIGS. 1 and 2, with freight car wheelsets located on the rack.
Figure 4:
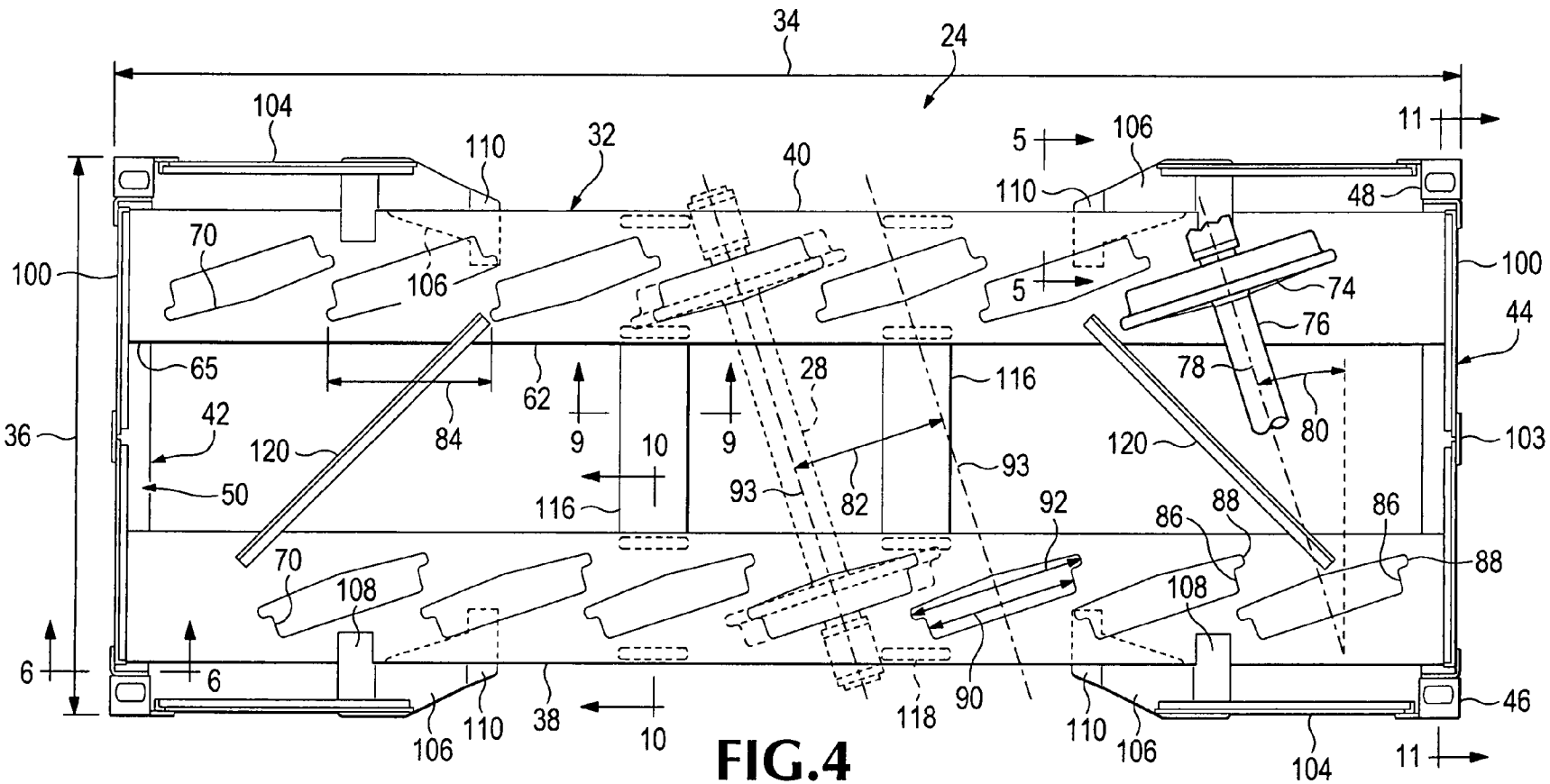
FIG. 4 is a top plan view of the rack shown in FIG. 3.

As shown in FIGS. 3 and 4, the support apparatus or rack 24 includes a generally rectangular frame structure which may be of steel, yet which is of modest weight. A frame 32 has a length 34, a width 36, and a height 37 and is generally rectangular in plan, as may be seen best in FIG. 4. A pair of parallel main longitudinal members 38 and 40 are spaced apart from each other laterally and extend from a first end assembly 42 to an opposite second end assembly 44. Each end assembly 42 or 44 includes a pair of corner posts 46 and 48 that are essentially mirror images of each other and define corners of the rack. Lower end portions of the corner posts 46 and 48 are connected with each other by a main transverse member 50 of each end assembly 42 or 44. The width 36 thus has a direction normal to the length 34 and parallel with the transverse bottom frame member 50 and includes the length of the transverse member 50 and the horizontal dimensions of the corner posts 46 and 48. The length 34 and width 36 may conveniently be the same as an established standard length and width of an intermodal cargo container, as will become readily apparent.

Figure 6:
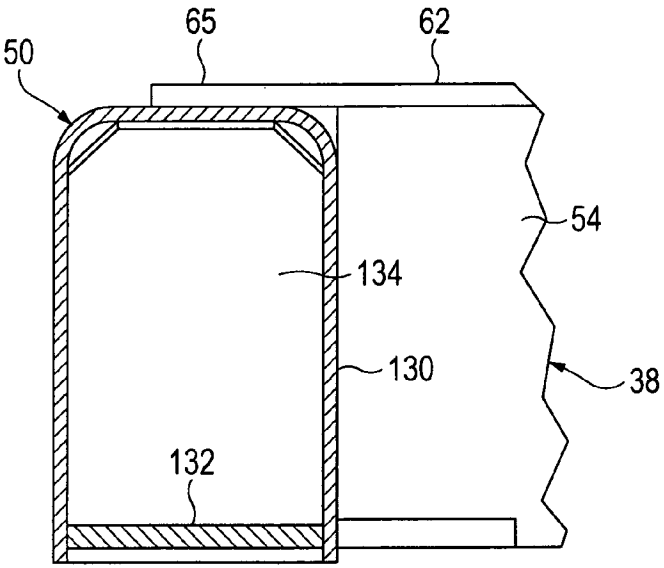
FIG. 6 is a sectional view taken along line 6-6 in FIG. 4.
Figure 5:
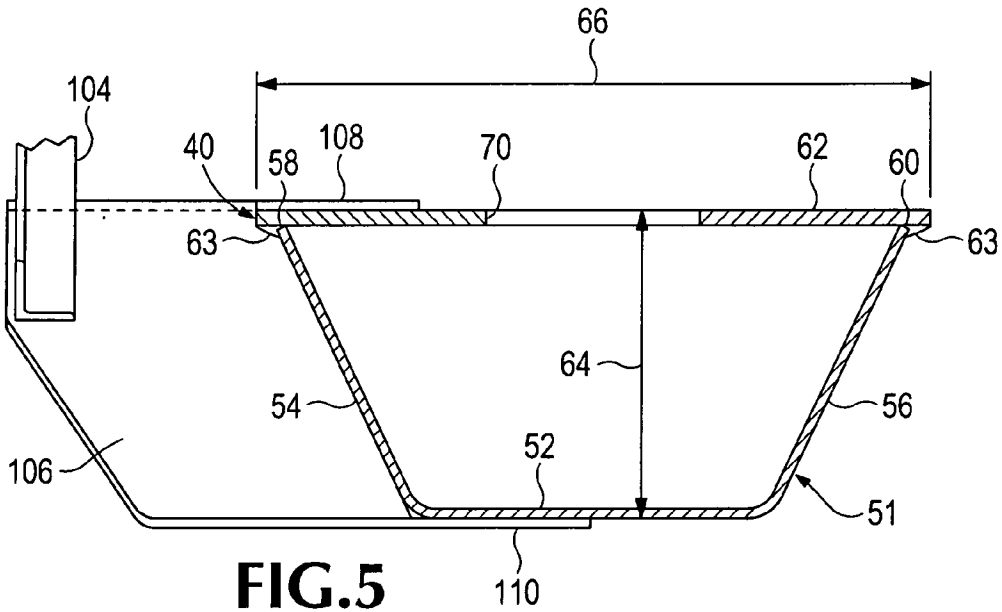
FIG. 5 is a sectional view taken along line 5-5 in FIG. 4.

Each of the main longitudinal members 38 and 40 is a generally trapezoidal box beam. A channel 51 that may be formed from a single plate bent along longitudinal lines defines a relatively narrow horizontal bottom side 52 and a pair of upwardly and outwardly sloping sides 54 and 56 of the box beam, as shown in FIG. 5. Upper margins 58 and 60 of the sides 54 and 56 are fastened, preferably by welding, to a horizontal top plate 62 that is the wide top member of each of the trapezoidal main longitudinal members 38 and 40. The top plate 62 may extend laterally beyond each of the upper margins 58 and 60 of the sloping laterally outer side 54 and inner 56, providing ample space for a fillet weld 63. The top plate 62 may be of thicker, and thus stiffer, material, such as steel plate ½ inch in thickness, while the channel 51 including the bottom 52 and the sloping sides 54 and 56 may be of thinner steel plate, 5/16 inch in thickness, for example. The thinner material of the channel 51 is sufficient for the required strength of the longitudinal member 38 or 40, while the sloping sides 54 and 56 and relatively narrow bottom 52 provide ample room inside the box beam shape without unnecessary material and its attendant weight. An end portion 65 of the top plate 62 may extend longitudinally beyond the channel 51 and rest atop the main transverse member 50, as may be seen in FIGS. 3 and 6. Each of the main longitudinal members may have a depth 64 of about 10 inches, and the width 66 of the top plate 62 may be about 22.75 inches, in one version of the rack 24.

The top plate 62 of each of the main longitudinal members 38 and 40 defines seven wheel-receiving openings 70 each shaped to receive a portion of one wheel of a wheelset 28. As seen best in FIG. 4, the top plates 62 of the two main longitudinal members 38 and 40 are identical but are arranged oppositely. The openings 70 are thus located and oriented so that each opening 70 is obliquely opposite and aligned with an opening 70 in the top plate 62 of the opposite one of the main longitudinal members 38 and 40. A wheelset 28 can thus be received with each of its wheels 72 and 74 in a respective one of the openings 70, with the central longitudinal axis 78, or axis of rotation, of the axle 76 extending horizontally and at an angle 80 in the range of about 15 to about 20 degrees with respect to the width 36 of the rack 24. The angle 80 is designed to provide room to receive the largest wheelset 28 intended to be carried without either the axle 76 or a flange 94 extending beyond the width 36 of the rack 24. While a smaller angle 80 may permit a larger number of wheelsets 28 of a particular wheel size to be carried, the angle 80 should be at least about 15 degrees in order to avoid interference between wheels 72,74 of adjacent wheelsets 28. An angle 80 greater than about 20 degrees can be utilized, but would probably reduce the number of wheelsets 28 that can be carried in such a rack 24 of the length 34 and width 36 of a 20-foot ISO container. Orientation of the axis of rotation 78 of a wheelset 28 for a standard gauge railcar at such an angle 80, in this case 18 degrees, with respect to the width 36 of the rack 24 allows such a wheelset 28 to fit on the rack 24 as shown in broken line in FIG. 4, without extending beyond the width 36.

Because of the ample thickness of the top plate 62 the openings 70 may simply be cut in the top plate, thus simplifying manufacture of the main longitudinal members 38 and 40. While thinner material could be used for the top plate 62, reinforcements (not shown) would then be advisable at the ends of the openings 70.

Figure 7:
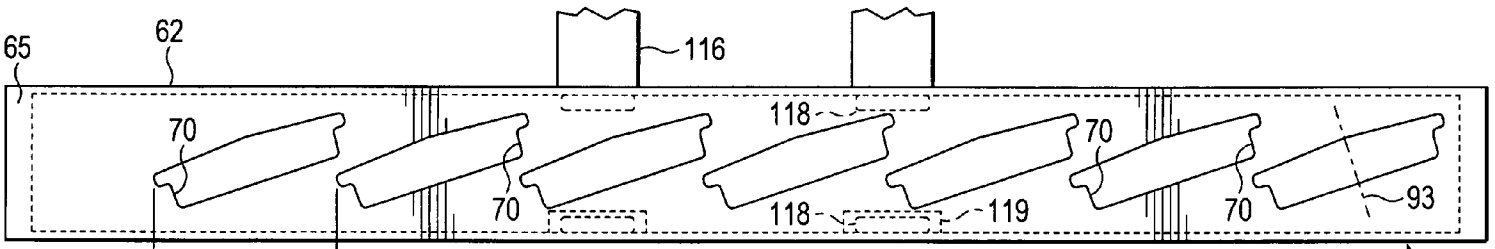
FIG. 7 is a top plan view of a main longitudinal member and portions of a pair of fork-lift receiving tubes that are part of the rack shown in FIG. 4.
Figure 8:
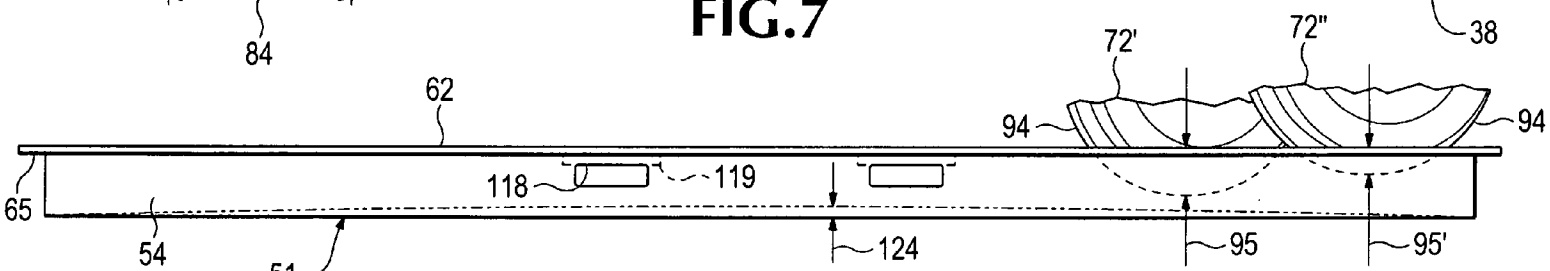
FIG. 8 is a side elevational view of the longitudinal member shown in FIG. 7.

Each opening 70 has a shape similar to the profile of a railroad car wheel, as may also be seen in FIG. 7, and thus has a wheel tread receiving portion 86, and a narrower flange-receiving portion 88 that extends beyond the tread-receiving portion 86. The wheel tread-receiving portion 86 may have a chord dimension 90 of about 26¾ inches and the flange receiving portion 88 may have a chord dimension 92 of about 31⅜ inches. Both parts 86 and 87 of the openings 70 extend equally on opposite sides of a centerline 93 aligned with the axis of rotation 78 of a wheelset 28 carried on the rack 24. The dimensions 90 and 92 thus extend along and define a chord of a wheel 72 or 74 of a wheelset 28 as it rests in the openings 70, to be supported in the rack 24. A given chord length will subtend a larger central angle of a circle of a smaller diameter, so the flange 94 of a wheel 72 or 74 of a smaller diameter, such as a 33-inch wheel 72', will extend more deeply downward into the longitudinal member 38 or 40 through one of the openings 70. Thus such a wheel 72', as shown in FIG. 8, may extend downward a distance 95 of about 8½ inches and may touch or nearly touch the bottom 52 of the channel portion 51 of the longitudinal member 40, depending somewhat on the amount by which the wheel 72' has been worn or machined to a reduced diameter. Because the same chord length 90 or 92 subtends a smaller central angle of a wheel whose diameter is larger, a 38-inch wheel 72" resting in the opening 70 may extend downward beneath the top of the top plate 62 a smaller distance 95' of, for example, at least about 6½ inches, or more likely about 6 11/16 inches. The dimensions 90 and 92 are selected to receive a wheel 72 or 74 to a great enough radial depth to engage the wheel securely yet preserve some space between the top plate 62 and the axle 78, and between the flange 94 of the wheel 72 or 74 and the bottom 52 of the longitudinal member 38 or 40.

The openings 70 may be located in each top plate 62 at a longitudinal spacing 84, in the direction of the length 34 of the rack, that is less than the diameter of the wheels 72 or 74, so as to require the wheels 72 and 74 of a wheelset 28 to overlap those of an adjacent wheelset 28 in the direction of the length 34 of the rack 24, in an echelon arrangement as may be seen in FIGS. 1, 2, and 4. The center-to-center axle spacing 82 required for the diameter of the largest wheels 72, 74 intended to be carried may be calculated by taking into account the size of a bearing assembly 85 and the minimum acceptable spacing between a wheel 72 or 74 and a bearing assembly 85. Thus, for such a rack 24 having a length 34 of 238.5 inches, consistent with that of a 20-foot ISO container, the center-to-center spacing 82 between wheelsets 28 may be about 27 7/16 inches, as measured normal to the axes of rotation 78 or the centerlines 93.

Because the longitudinal spacing 84 of the openings 70 along the length dimension 34 of the rack 24 is fixed, the distance 96 by which a flange of a larger wheel 72 is separated from an axle 76 or bearing assembly 85 of an adjacent similar wheelset 28 is smaller than the distance 96 by which a flange of a smaller wheel 72 is separated from the axle or bearing assembly of an adjacent similar wheelset 28.

Even for a wheelset 28 with 38-inch diameter wheels 72 and 74, with openings 70 having the dimensions 90 and 92 disclosed above, each wheel 72 or 74 extends down far enough through the openings 70 so that a 40 percent higher deceleration, compared to the traditional non-angled wheel slots in a direction parallel with the length 34 of the rack 24, would be needed for such a wheelset 28 to roll up and out of its pair of openings 70. Since the axis of rotation 78 is oriented at the angle 80 to the direction of travel of the rack 24 in a railcar container well 22, for any acceleration or deceleration of the rack 24 in the direction of its usual travel, the component that is normal to the axis of rotation 78 of the axle 76 is significantly less than the deceleration of the rack 24, and a wheelset 28 would thus not roll out of position in the rack as a result of normal operation of a train nor as a result of a head-on collision involving a train carrying a loaded rack 24 or 26 unless the deceleration of the car is at least 40 percent greater than enough to dislodge such a wheelset in chocks holding the axis of rotation 78 normal to the direction of movement of the car. Furthermore, the component of deceleration of the railroad car or trailer that is oriented along the axis of rotation 78 of the wheelset 28 will result in the margins of the openings 70 tending to press upon the sides of the wheels 72 or 74, causing friction that would oppose movement of a wheelset 28 out from the openings 70.

The corner posts 46 and 48 are attached to the main transverse member 50 as by being welded to the respective ends of the main transverse member 50 of each end assembly 42 or 48. Additionally, lateral diagonal support, or brace, members 100 extend from upper end portions 102 of the corner posts 46 and 48 toward the main transverse member 50, and are attached to the main transverse member 50 through a plate 103. Longitudinal diagonal support, or brace, members 104 extend from the upper end portions 102 of the corner posts to attachment plates 106, which may be seen in FIGS. 3, 4, and 5. The diagonal braces 100 and 104 may be of 2 inch×2 inch×¼ inch angle stock, for example. The attachment plates 106 interconnect a lower end of each longitudinal diagonal brace member 104 with the nearer main longitudinal member 38 or 40.

Each attachment plate 106 includes an upper horizontal portion 108 lying atop and welded to the top plate 62 and a lower horizontal portion 110 extending along and welded to the bottom side 52 of the main longitudinal member 38 or 40. A sloping intermediate portion of the attachment plate 106 extends diagonally downward in alignment with the diagonal brace member 104 and is welded to the laterally outer sloping side 54 of the channel portion 51. The diagonal brace members 100 and 104 thus provide ample support for the corner posts 46 and 48 with only a small amount of weight.

Figure 10:
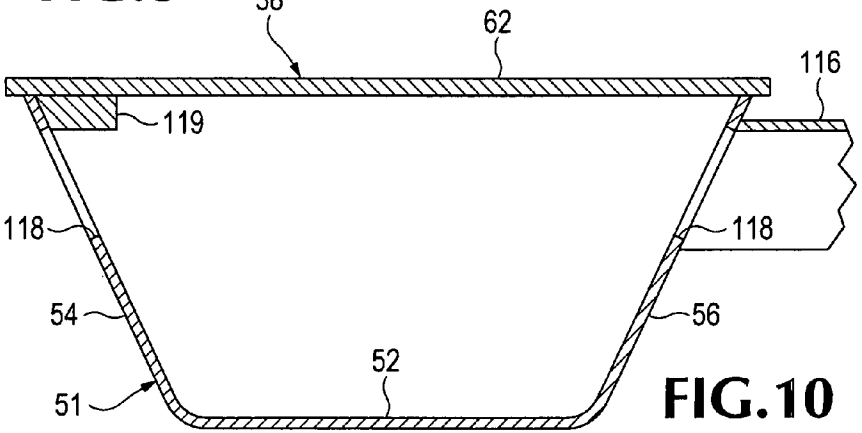
FIG. 10 is a sectional view taken along line 10-10 in FIG. 4.
Figure 9:
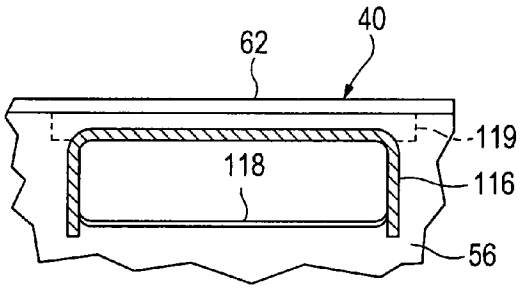
FIG. 9 is a sectional view taken along line 9-9 in FIG. 4.

A pair of downwardly open channel members 116 are welded to and extend transversely between the main longitudinal members 38 and 40. These channel members 116 are aligned with respective openings 118 through the sloping sides 54 and 56 of each main longitudinal member 38 and 40 as shown in FIGS. 9 and 10, to permit the rack 24 to be carried by a forklift. A reinforcement block 119 may be placed between the top plate 62 and the top of the opening 118, against the laterally outer sloping side 54 on each of the main longitudinal members 38 and 40, to distribute the forces applied by use of a forklift.

Diagonal horizontal braces 120, which may be of steel angle stock similar to that of the diagonal braces 100 and 104, may be welded to the top plates 63 of the main longitudinal members 38 and 40, extending between them near the longitudinal ends of the rack 24.

As shown in FIG. 8, each main longitudinal member 38 and 40 may be constructed with a camber 124 to accommodate the weight of the wheelsets 28 so that the weight of the loaded rack will consistently be carried through the corner posts 46 and 48 when a fully loaded rack 24 is carried on a railcar, is stacked atop another such rack 24, or rests on the ground.

Figure 11:
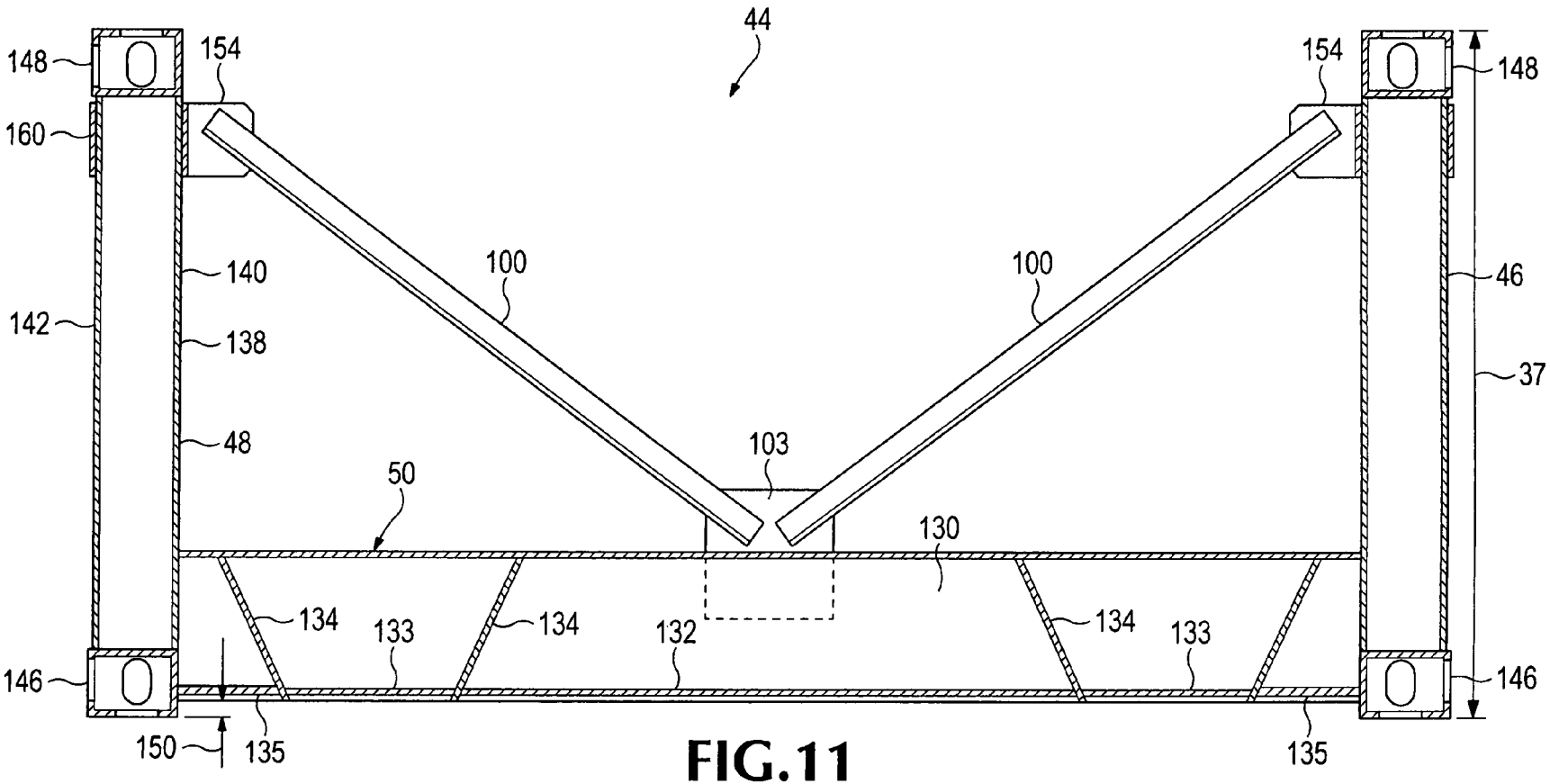
FIG. 11 is a sectional view taken along line 11-11 of FIG. 4.

The end assemblies 42 and 44 are substantially similar to each other, and so it is not necessary to describe each separately in detail. As may be seen in FIGS. 6 and 11, the end assembly 44 includes the main transverse member 50, which may be constructed as a downwardly-open channel member 51, closed by bottom closure plates 132 and 133 and reinforced by internal stiffener plates 134, each of which is aligned with one of the sloping sides 54 and 56 of the channel 51. A short bottom closure plate 135 adjacent each corner post 46 or 48 and extending to the nearer one of the stiffener plates 134 may be of heavier material in order to carry loads from the main longitudinal members 38 and 40 to the corner posts 46 and 48.

Figure 12:
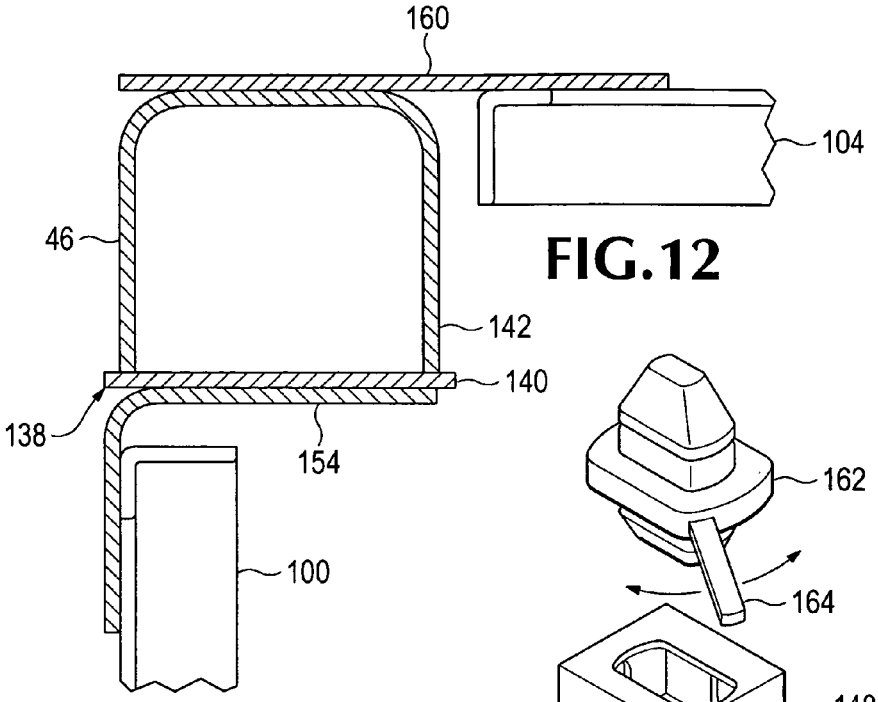
FIG. 12 is a sectional view taken along line 12-12 of FIG. 3.
Figure 13:
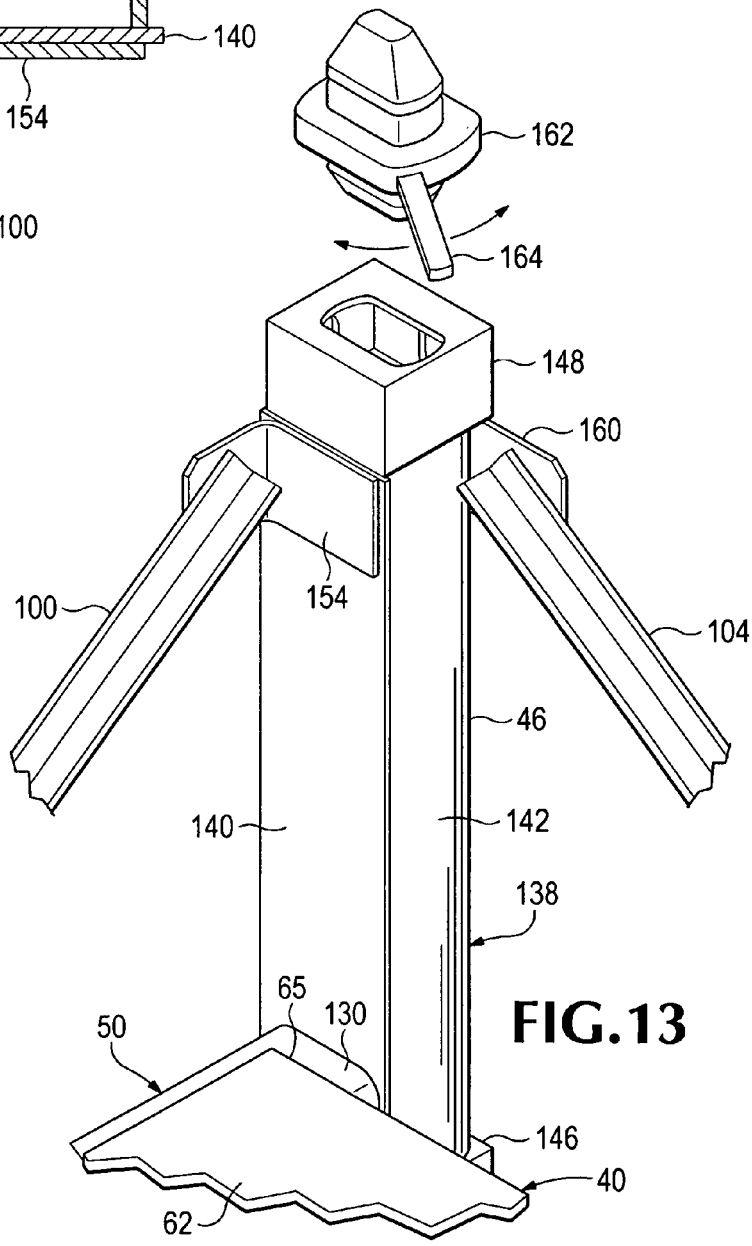
FIG. 13 is an isometric view of a portion of the rack shown in FIG. 3, at an enlarged scale.

The corner posts 46 and 48 are mirror opposites of each other. The main part of each may be constructed as a generally rectangular tube 138, as shown in FIGS. 12 and 13, by welding a flat plate 140 to the legs of a channel 142 which may be of formed plate. The rectangular tube 138 thus formed may have a bottom corner fitting 146 welded to its bottom end and a top corner fitting 148 welded to its top end. The top and bottom corner fittings 148, 146 may be conventional intermodal cargo container corner fittings. The corner fittings 146 and 148 may be aligned flush with the plate 140. The main transverse member 50 is welded to the corner posts 46 and 48 so that each bottom corner fitting 146 extends downward a distance 150, for example 1.5 inch, beneath the main transverse member 50 of each end assembly 42 and 44, to ensure ample clearance between a rack 24 and a cargo container, another rack 24, or a floor on which a rack 24 is to be placed, ensuring that the bottom corner fittings 146 carry substantially the entire weight of the rack and any wheelsets 28 that are carried on it, and giving room for operation of an inter-box connector.

Referring still to FIGS. 12 and 13, an upper bracket 154 which may be of bent steel plate has one leg welded flush against the flat plate 140 of each corner post, while another leg extends perpendicularly toward the opposite corner post. Each diagonal brace 100 is welded to one of the upper brackets 154 and to the rectangular plate 103 welded to the longitudinally outer side of the channel 130 to support the corner posts 48 and 46 in a lateral direction.

A planar mounting plate 160 may be welded flush against the laterally outwardly facing base or web of the channel 142 of each corner post 46 and 48 and extends longitudinally of the rack 24 toward the opposite end. The top and corner bottom corner fittings 148, 146 are slightly wider than the tube 138 and may be located so as to provide a small overhang distance with respect to the channel member 142 so that the mounting plate 160 has its outer face aligned flush with an outer face of the top corner fitting 148 of each corner post 46 or 48. An upper end of each diagonal brace member 104 may be welded to an inner face of a respective mounting plate 160 and its opposite, lower, end may also be welded to an upper surface of a respective one of the attachment plates 106 extending laterally from the nearer one of the main longitudinal members 38 and 40. The diagonal brace member 104 thus has its laterally outer face in a longitudinal vertical plane and provides bracing for the upper portions 102 of the corner posts 46 and 48 in a direction parallel with the length 34 of the rack 24.

Figure 14:
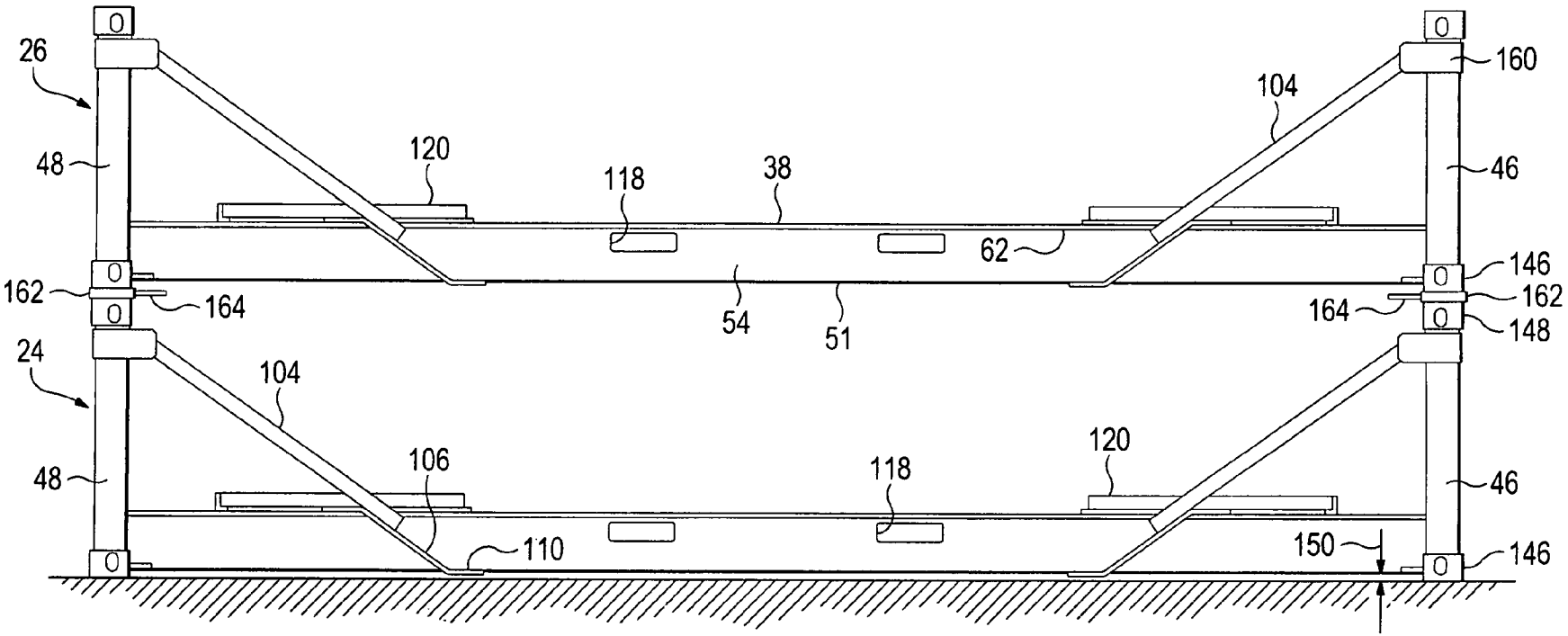
FIG. 14 is a side elevational view of a pair of racks such as that shown in FIG. 4, stacked one atop the other and interconnected.

A conventional inter-box connector 162, shown best in FIG. 13, has a handle 164. The inter-box connector 162 may be used to interconnect a pair of stacked racks 24 and 26 to be carried in a container well car 20, as shown in FIG. 1, on a flatcar, as shown in FIG. 2, or otherwise carried to a desired destination in the space of a conventional intermodal cargo container, or to be stored for an extended period of time, as shown in FIG. 14. The entire height 37 of the rack 24, defined by the corner posts 46 and 48, including the corner fittings 146 and 148, may be about 47⅜ inches, thus slightly less than 48 inches, and thus less than half the 8-foot height of a standard ISO 20-foot cargo container by the distance needed for the connector 162 between the racks 24 and 26, so that the two racks 24, 26 can be stacked and connected, to fit in place of a single standard 20-foot container of 8 feet in height in a container well 22 of a railcar 20, as shown in FIG. 1. The height 37 may, alternatively, be slightly greater, up to about half of the height of a standard container of a greater height to allow two of the racks 24, 26 to fit in a space intended to receive a cargo container having a greater standard height of 8 feet, 6 inches, or 9 feet, or 9 feet, 6 inches. Thus the height 37 might be as great as 50⅜ inches, or 53⅜ inches, or 56⅜ inches to allow such a stacked pair of racks 24, 26. At least when a pair of racks 24, 26 are to be handled as a unit corresponding to handling a single ISO 20-foot cargo container, the handle 164 should be directed inward, as shown in FIGS. 1, 2, and 15, to avoid interference with obstacles such as adjacent cargo containers.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A railcar wheelset support rack, comprising:

(a) a pair of laterally extending support structures defining a width; and (b) a pair of longitudinal main members spaced apart from each other laterally, each one of the pair of longitudinal main members including a top member defining a plurality of wheel-receiving openings, each said wheel-receiving opening being paired with a corresponding wheel-receiving opening in the other one of said pair of longitudinal main members, the ones of each pair of wheel-receiving openings being located with respect to each other at an oblique angle with respect to the width of the rack.

2. The rack of claim 1 wherein each laterally extending support structure is an end assembly and defines a pair of corners of the rack and wherein each one of said corners includes an intermodal cargo container corner fitting.

3. The rack of claim 1 having a height that is no greater than 57 inches.

4. The rack of claim 1 wherein each of said wheel-receiving openings in said top member is large enough to receive a wheel of a wheelset to protrude to a depth of at least about 6½ inches below an upper surface of said top member.

5. The rack of claim 1 wherein each of said wheel-receiving openings has a centerline, and wherein the centerlines of a pair of said corresponding wheel-receiving openings coincide and define said oblique angle.

6. The rack of claim 5 wherein said oblique angle is in the range of about 15 degrees to about 20 degrees.

7. The rack of claim 6 wherein said oblique angle is about 18 degrees.

8. The rack of claim 2 wherein each said end assembly includes a pair of corner posts and wherein each said corner post has a corner fitting compatible with an inter-box connector for intermodal cargo containers.

9. The rack of claim 8 wherein each said corner post has a top and a bottom and includes a respective corner fitting at each of said top and said bottom.

10. The rack of claim 1 wherein each said laterally extending support structure includes an end assembly that includes a transverse bottom frame member and a pair of corner posts interconnected by said transverse bottom frame member.

11. The rack of claim 10 including a lateral diagonal support member extending from said transverse bottom frame member to an upper portion of one of said corner posts.

12. The apparatus of claim 10 including a longitudinal diagonal support member extending from an upper portion of one of said corner posts downward toward one of said longitudinal main members.

13. The apparatus of claim 1 wherein one of said longitudinal main members is a trapezoidal box beam having a horizontal bottom side and a horizontal top that is wider than said horizontal bottom side.

14. The apparatus of claim 13 wherein said horizontal top of said trapezoidal box beam includes said top member.

15. The apparatus of claim 14 wherein said wheel-receiving openings defined in said top member are shaped to receive a railroad car wheel including a flange, to a limited radial depth with respect to said wheel that is small enough to maintain a distance between an axle of a wheelset including said wheel and said top member.

* * * * *